US008888388B2

(12) United States Patent
Mochida et al.

(10) Patent No.: US 8,888,388 B2
(45) Date of Patent: Nov. 18, 2014

(54) PRINTER WITH CUTTER UNIT HAVING BLADE WITH ADHESION-RETARDANT AGENT

(75) Inventors: Sadayoshi Mochida, Shizuoka (JP); Tsuyoshi Sanada, Singapore (SG)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 260 days.

(21) Appl. No.: 13/158,564

(22) Filed: Jun. 13, 2011

(65) Prior Publication Data

US 2012/0027496 A1 Feb. 2, 2012

(30) Foreign Application Priority Data

Jul. 29, 2010 (JP) ..... 2010-170950

(51) Int. Cl.

| | |
|---|---|
| ***B41J 11/70*** | (2006.01) |
| ***B26D 1/08*** | (2006.01) |
| ***B26D 1/00*** | (2006.01) |
| *B26D 5/14* | (2006.01) |

(52) U.S. Cl.

CPC ..... *B41J 11/70* (2013.01); *B26D 1/085* (2013.01); *B26D 1/0006* (2013.01); *B26D 5/14* (2013.01); *B26D 2001/002* (2013.01); *Y10S 83/922* (2013.01)

USPC ..... 400/621; 83/694; 83/922

(58) Field of Classification Search

CPC ..... B41J 11/703; B26D 1/085

USPC ..... 400/621; 83/694, 922

See application file for complete search history.

(56) References Cited

U.S. PATENT DOCUMENTS

| | | | | |
|---|---|---|---|---|
| 6,145,561 | A * | 11/2000 | Watanabe et al. | 156/517 |
| 6,831,670 | B2 * | 12/2004 | Fujiwara | 347/222 |
| 2006/0137827 | A1 * | 6/2006 | Uneyama et al. | 156/510 |
| 2007/0296799 | A1 * | 12/2007 | Watanabe et al. | 347/222 |
| 2010/0192746 | A1 * | 8/2010 | Flood et al. | 83/697 |

FOREIGN PATENT DOCUMENTS

| | | | | |
|---|---|---|---|---|
| JP | 10217182 | A * | 8/1998 | B26D 1/08 |
| JP | 10217184 | A * | 8/1998 | B26D 1/08 |
| JP | 2000-062264 | | 2/2000 | |
| JP | 2000052292 | A * | 2/2000 | B26D 1/08 |
| JP | 2001341932 | A * | 12/2001 | B65H 35/08 |
| JP | 2002144657 | A * | 5/2002 | B41J 15/04 |
| JP | 2004-148442 | | 5/2004 | |

(Continued)

OTHER PUBLICATIONS

Office Action of Grounds for Rejection for Japanese Patent Application No. 2010-170950 Dated May 8, 2012, 3 pgs.

*Primary Examiner* — Daniel J Colilla

(74) *Attorney, Agent, or Firm* — Amin, Turocy & Watson, LLP

(57) ABSTRACT

A cutter unit that includes a conveying mechanism, a first blade, and a second blade. The conveying mechanism conveys a print paper having a print surface and an adhesive surface. The first blade is provided on a conveying path of the print paper conveyed by the conveying mechanism to face the print surface of the print paper. The second blade is provided on the conveying path to face the adhesive surface. The second blade includes a cutting surface configured to cut the print paper inserted between the second blade and the first blade, and a contact surface configured to contact the adhesive surface of the print paper on the conveying path. The contact surface of the second blade is coated with an adhesion-retardant agent.

8 Claims, 7 Drawing Sheets

(56) References Cited

FOREIGN PATENT DOCUMENTS

| | | | | | |
|---|---|---|---|---|---|
| JP | 2004148440 | A | * | 5/2004 | B26D 1/08 |
| JP | 2004148442 | A | * | 5/2004 | B26D 1/08 |
| JP | 2004298989 | A | * | 10/2004 | B26D 1/30 |
| JP | 2007160782 | A | * | 6/2007 | B41J 11/70 |

* cited by examiner

PRINTER WITH CUTTER UNIT HAVING BLADE WITH ADHESION-RETARDANT AGENT

CROSS-REFERENCE TO RELATED APPLICATIONS

This application is based upon and claims the benefit of priority from Japanese Patent Application No. 2010-170950, filed on Jul. 29, 2010, the entire contents of which are incorporated herein by reference.

FIELD

Embodiments described herein relate generally to a cutter unit and a printer.

BACKGROUND

A label printer includes a cutter unit including a fixed blade, which is disposed across a print paper, and a movable blade which is movable to cut the print paper interposed between the movable blade and the fixed blade.

In many cases, however, the cutter unit of the label printer cuts a print paper having an adhesive-applied surface on which an adhesive agent is applied, such as a label attached to a backing sheet or a linerless label. In such cases, the adhesive agent applied on the adhesive-applied surface of the print paper may adhere to the movable blade of the cutter unit, which may cause a jamming of the print paper due to the adhesion of the print paper to the movable blade while the print paper is being conveyed.

In addition, in recent years, a label having a backing sheet has been found to cause environmental problems since the backing sheet is discarded as waste when a printed label is peeled off of the backing sheet. Thus, a linerless label has been widely used as print paper. However, since the linerless label is conveyed with its adhesive-applied surface exposed, an adhesive agent applied on the adhesive-applied surface of the linerless label may adhere more easily to the movable blade of the cutter unit than a label having a backing sheet, which may result in more frequent jamming of the printer.

DETAILED DESCRIPTION

According to one embodiment, a cutter unit includes a conveying mechanism configured to convey a print paper having a print surface and an adhesive surface. The cutter unit also includes a first blade provided on a conveying path of the print paper conveyed by the conveying mechanism to face the print surface of the print paper and a second blade provided on the conveying path to face the adhesive surface. The second blade includes a cutting surface configured to cut the print paper inserted between the second blade and the first blade, and a contact surface configured to contact the adhesive surface of the print paper on the conveying path. The contact surface of the second blade is coated with an adhesion-retardant agent.

Embodiments will now be described in detail with reference to the drawings.

Figure 1:
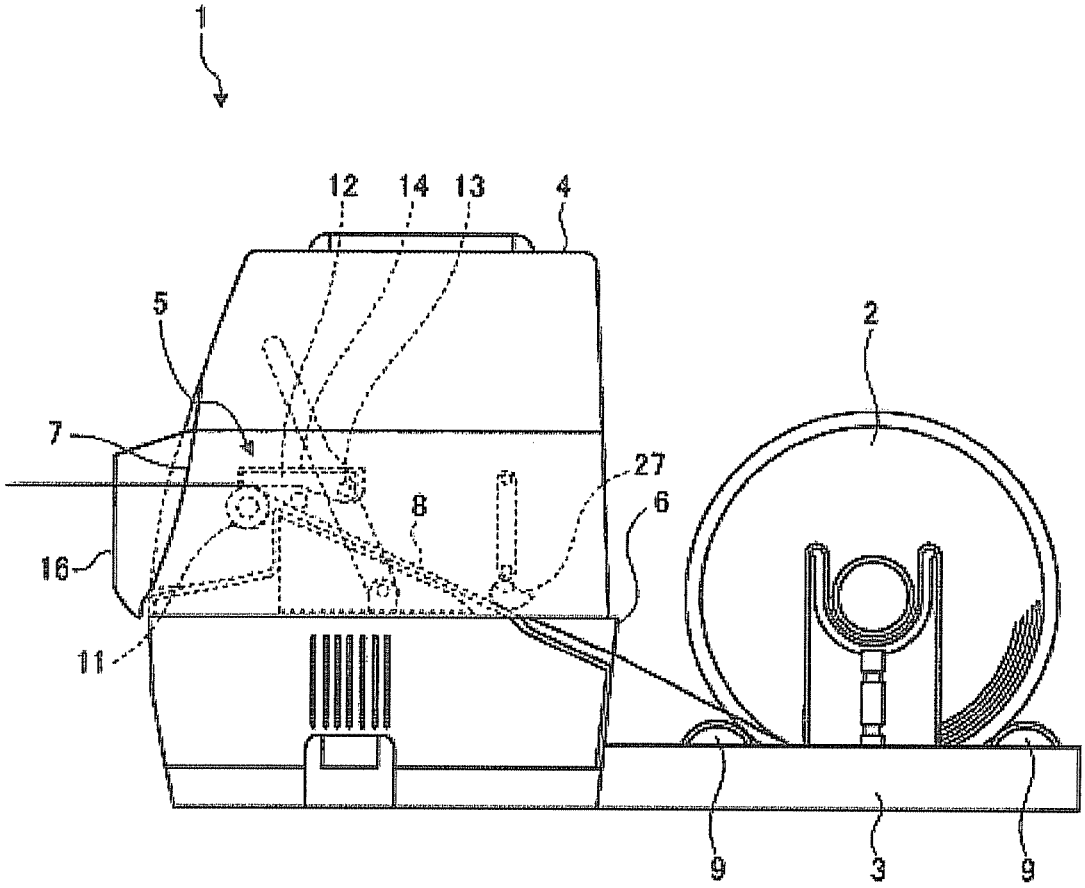
FIG. 1 is a schematic side sectional view showing a label printer according to a first embodiment.

FIG. 1 is a schematic side sectional view showing a label printer according to a first embodiment. A label printer 1 includes a paper holding part 3 which is disposed outside a housing 4 to hold a continuous paper 2. The label printer 1 introduces (or draws) the continuous paper 2 held in the paper holding part 3 into the housing 4, and then prints predetermined information on the introduced continuous paper 2 by means of a printing mechanism 5 accommodated in the housing 4. In this embodiment, the continuous paper 2 may be a print paper that has an adhesive surface such as, for example, an adhesive-applied surface 2*a* (see FIG. 4, etc.) on which an adhesive agent is applied, such as a backing sheet attached label, a linerless label, or the like. In this embodiment, an example of the continuous paper 2 may include a label paper or a tag-embedded paper in the form of a rolled paper.

A conveying path 8 extending from a paper feed opening 6 to a discharge opening 7 is formed within the housing 4. The continuous paper 2 is conveyed by a pair of rotatable paper holding rollers 9 disposed in the paper holding part 3, such that the continuous paper 2 is introduced from the paper feed opening 6 into the conveying path 8 and then is guided to be discharged from the discharge opening 7.

The printing mechanism 5 is provided on the conveying path 8 along which the continuous paper 2 is conveyed. The printing mechanism 5 includes a platen roller 11 serving as a conveying mechanism, which is rotated by a stepping motor (not shown) to convey the continuous paper 2 introduced into the housing 4, and a line thermal head 12 opposing the platen roller 11 with the continuous paper 2 interposed there between. The line thermal head 12 is held by a head holding plate 14, which is rotatably supported by a support shaft 13 provided in parallel with a rotating shaft of the platen roller 11. The head holding plate 14 may be pressed against the platen roller 11 by means of a spring (not shown) so that the line thermal head 12 is biased against the platen roller 11. In addition, a cutter unit 16 is provided upstream of the paper discharge opening 7.

In this embodiment, to issue a label for which printing is completed by the printing mechanism 5, the label printer 1 may select one of two types of issuance operations. In one of the two operations, a label is issued by cutting a backing sheet for each label using the cutter unit 16. In the other type of operation, a label is issued by cutting the continuous paper 2 to a predetermined length using the cutter unit 16. A structure and control thereof will be omitted for clarity of description.

In addition, in this embodiment, the label printer 1 employs a line type printing method. The line thermal head 12 has a plurality of heating elements (not shown) arranged in a line and performs a printing operation in a main scan direction using the plurality of heating elements. The line thermal head 12 performs a printing operation in a sub scan direction by the movement of the continuous paper 2 with respect to the line thermal head 12, the movement caused by conveyance of the continuous paper 2. Thus, detection of a conveyance speed of the continuous paper 2 is required for the printing operation in the sub scan direction. For the detection of the conveyance speed, in this embodiment, a sensor unit 27 including two sensors such as a transmission type sensor and a reflection type sensor is provided on the conveying path 8.

Figure 2:
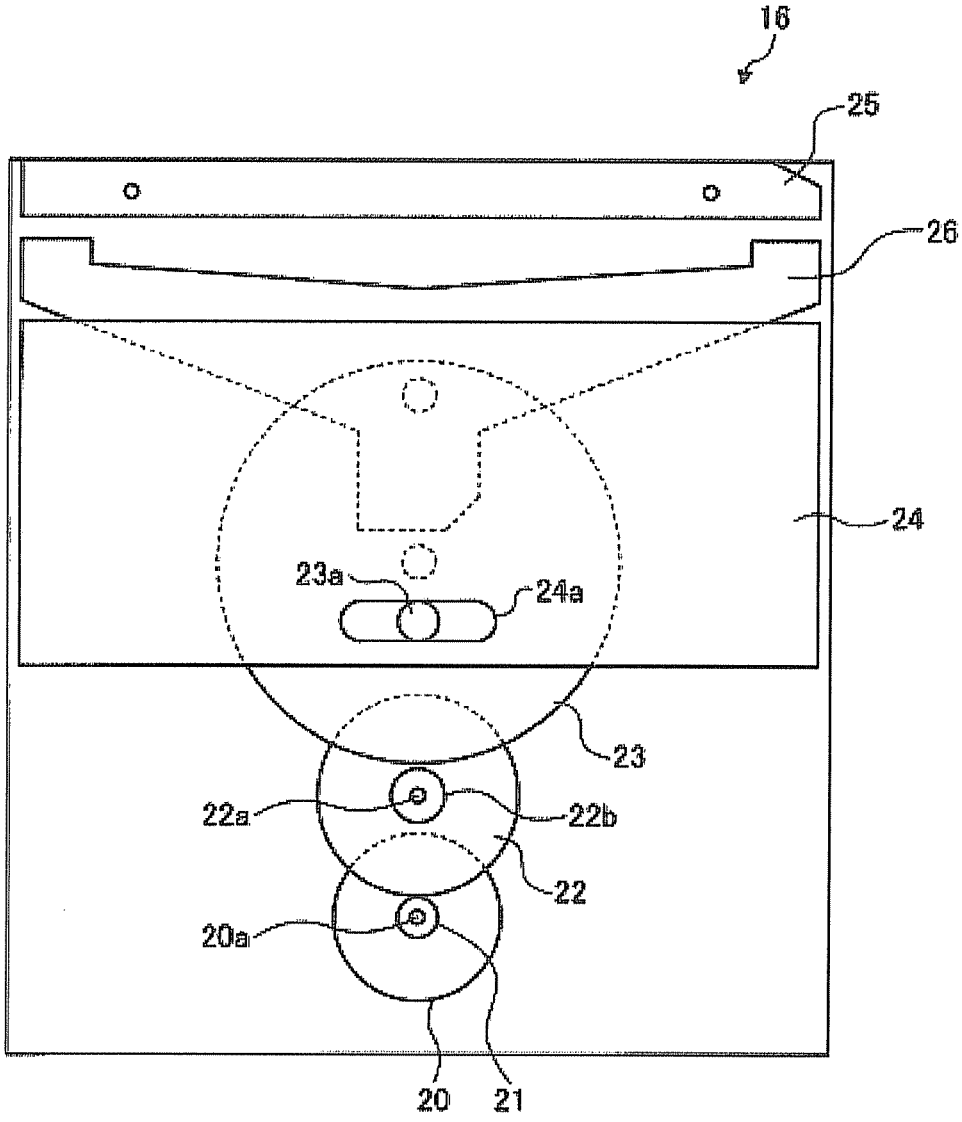
FIG. 2 is a front view showing an illustrative embodiment of a cutter unit in the label printer.

FIG. 2 is a front view showing an illustrative embodiment of the cutter unit in the label printer. The cutter unit 16 is also called a "guillotine cutter" and includes a motor 20, a driven gear 22, a rolling body 23, a movable blade holding member 24, a fixed blade 25, and a movable blade 26.

The motor 20 may rotate to provide a driving force to the movable blade 26. The motor 20 includes a driving gear 21 which is disposed at a leading end portion of a shaft 20*a* of the motor 20 and transfers a driving force to the movable blade 26.

The driven gear 22 is driven to be rotated in engagement with the driving gear 21 at one end of an edge portion. The driven gear 22 includes a driving gear 22*b* which is provided at a leading end portion of a shaft 22*a* of the driven gear 22 and transfers a driving force to the rolling body 23.

The rolling body 23 is driven to be rotated in engagement with the driving gear 22*b* of the driven gear 22. The rolling body 23 includes a fixing pin 23*a* provided at a position eccentric from the center of the rolling body 23. The position of the fixing pin 23*a* is changed when the rolling body 23 rotates.

The movable blade holding member 24 holds the movable blade 26 in an upper side of the cutter unit 16. The movable blade holding member 24 includes a cam groove 24*a* in which the fixing pin 23*a* of the rolling body 23 is inserted. With this configuration, the movable blade holding member 24 is moved to the upper or lower side of the cutter unit 16 depending on change in position of the fixing pin 23*a* of the rolling body 23.

The fixed blade 25 (serving as a "first blade") is disposed to face a print surface 2*b* opposite the adhesive-applied surface 2*a* of the continuous paper 2 (i.e., at the upper side of the cutter unit 16) in the conveying path 8 and is arranged perpendicular to a feeding direction of the continuous paper 2 printed with predetermined information by the printing mechanism 5. That is, the fixed blade 25 is disposed above the conveying path 8 and is fixed in the cutter unit 16 by a fastening member (not shown). On the other hand, the movable blade 26 (serving as a "second blade") is provided to face the adhesive-applied surface 2*a* of the continuous paper 2 in the conveying path 8 and cuts the continuous paper 2 interposed between the movable blade 26 and the fixed blade 25 when the movable blade 26 is moved toward the upper side of the cutter unit 16 as the movable blade holding member 24 is moved. The movable blade 26 is disposed below the conveying path 8 and cuts the continuous paper 2 interposed between the movable blade 26 and the fixed blade 25 when the movable blade 26 is moved to the upper side of the cutter unit 16 as the movable blade holding member 24 is moved.

Figure 3:
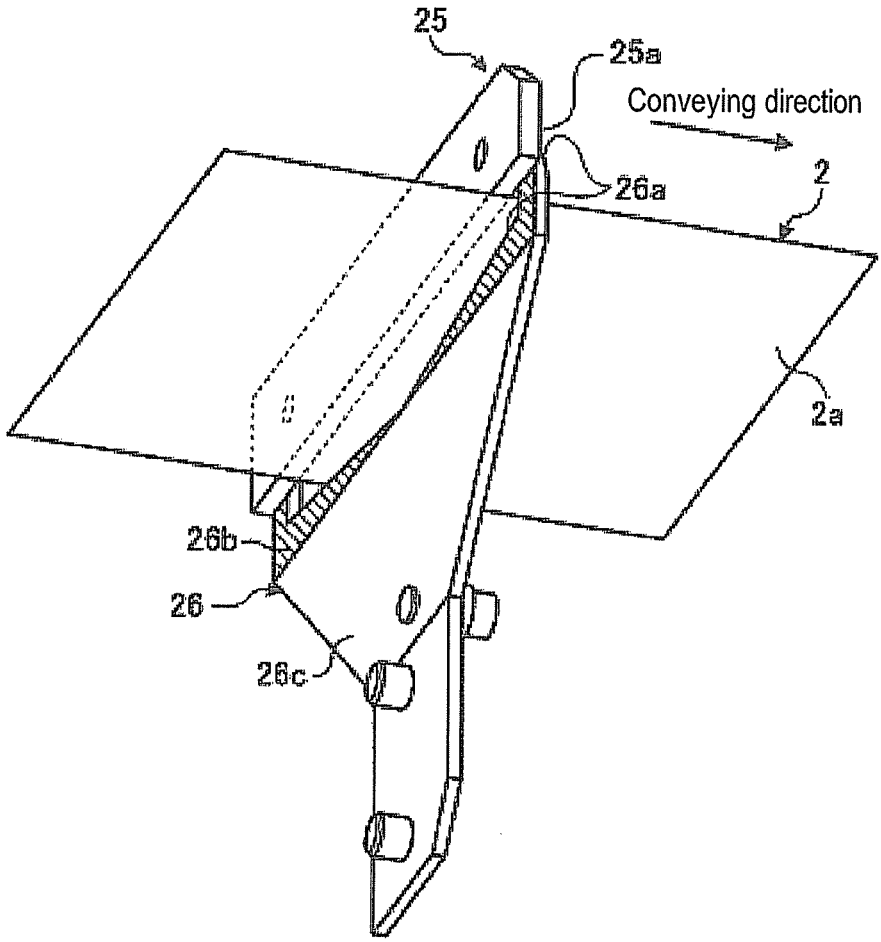
FIG. 3 is a perspective view showing a configuration of a fixed blade and a movable blade.
Figure 4A:
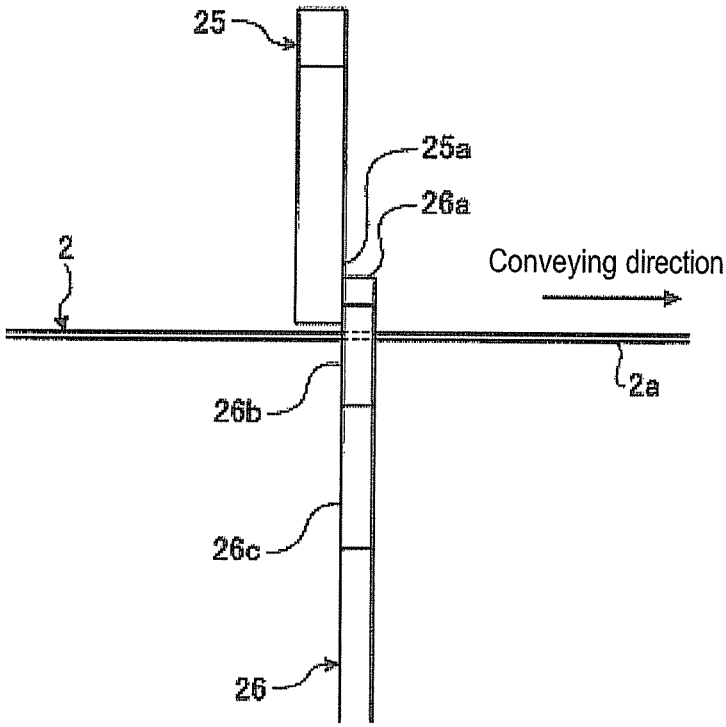
FIG. 4A is a side view showing a configuration of the fixed blade and the movable blade.
Figure 4B:
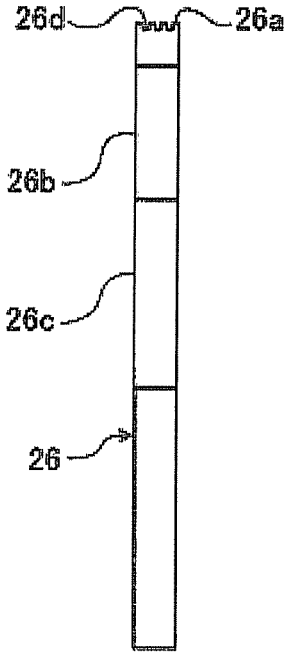
FIG. 4B is a side sectional view showing a configuration of the movable blade.

A configuration of the fixed blade 25 and the movable blade 26 will be described in detail with reference to FIGS. 3 and 4. FIG. 3 is a perspective view showing a configuration of the fixed blade and the movable blade. FIG. 4A is a side view showing a configuration of the fixed blade and the movable blade. FIG. 4B is a side sectional view showing a configuration of the movable blade.

The fixed blade 25 includes a cutting surface 25*a* configured to cut the continuous paper 2 inserted between the fixed blade 25 and the movable blade 26.

The movable blade 26 includes a cutting surface 26*b* configured to cut the continuous paper 2 inserted between the cutting surface 26*b* and the cutting surface 25*a* of the fixed blade 25 by sliding the cutting surface 25*a* on the cutting surface 26*b*. The movable blade 26 further includes a contact surface 26*a* configured to contact the adhesive-applied surface 2*a* of the continuous paper 2 in the conveying path 8, and an opposite surface 26*c* which is disposed below the cutting surface 26*b* in continuation with the cutting surface 26*b* and configured to oppose the fixed blade 25. In this embodiment, it is assumed that the movable blade 26 is entirely coated with an adhesion-retardant agent such as Teflon® or a paper anti-attachment paint, except the cutting surface 26*b*. An example of the paper anti-attachment paint may include BYCOAT® (available from Yoshida SKT, Co., Ltd.), PAPYLESS® (available from Natoco Paints, Co., Ltd.), DEFRIC® (available from Gawayuu Research, Co., Ltd.), etc.

Herein, a method of manufacturing the movable blade 26 according to this embodiment will be described in brief. First, the movable blade 26 including the cutting surface 26*b*, the contact surface 26*a* and the opposite surface 26*c* is entirely subjected to a surface treatment (including painting) with an adhesion-retardant agent such as Teflon® or a paper anti-attachment paint before the cutting surface 26*b* is grinded. Then, only the cutting surface 26*b* of the movable blade 26 is grinded, leaving the adhesion-retardant agent on all the surfaces of the movable blade 26 except the cutting surface 26*b* (i.e., all the surfaces except the cutting surface 26*b* are coated with the adhesion-retardant agent).

As an alternative, all the surfaces of the movable blade 26 except the cutting surface 26*b* may be subjected to a surface treatment with an adhesion-retardant agent after the cutting surface 26*b* is grinded (i.e., after the movable blade 26 is formed). As another alternative, all the surfaces of the movable blade 26 except the cutting surface 26*b* may be subjected to a surface treatment with an adhesion-retardant agent after the cutting surface 26*b* is grinded and recess portions (grooves) 26*d* are formed in the opposite side to the conveying path 8 (see FIG. 4B).

In this manner, as the contact surface 26*a* of the movable blade 26 is coated with the adhesion-retardant agent, even when the adhesive-applied surface 2*a* of the continuous paper 2 conveyed on the conveying path 8 contacts the contact surface 26*a*, the continuous paper 2 may be easily taken off from the contact surface 26*a*. This prevents a jamming of the continuous paper 2 due to the adhesion of the continuous paper 2 to the contact surface 26*a*. In addition, even if the adhesive agent applied on the adhesive-applied surface 2*a* is attached to the contact surface 26*a*, since adhesion between the contact surface 26*a* and the adhesive agent attached to the contact surface 26*a* is weak, it is possible to remove the adhesive agent from the contact surface 26*a*.

In addition, in this embodiment, as the opposite surface 26*c* of the movable blade 26 is coated with the adhesion retardant agent, even if the adhesive agent is attached to the cutting surface 26*b* when the continuous paper 2 is cut, the adhesive agent attached to the cutting surface 26*b* may flow down to the opposite surface 26*c*, which may prevent cutting failure due to the adhesive agent being attached to the cutting surface 26*b*. In addition, when the movable blade 26 slides on the cutting surface 25*a* of the fixed blade 25, it is possible to prevent the adhesive agent attached to the cutting surface 26*b* of the movable blade 26 from adhering to the cutting surface 25*a* of the fixed blade 25, which may prevent the cutting failure of the continuous paper 2.

In addition, in this embodiment, the contact surface 26*a* and the opposite surface 26*c* are coated with the adhesion-retardant agent for preventing a jamming of the continuous paper 2 due to the adhesion of the adhesive agent to the contact surface 26*a* and preventing cutting failure of the continuous paper 2 due to the adhesion of the adhesive agent to the cutting surface 26*b*. However, it is sufficient to only coat at least the contact surface 26*a* with the adhesion-retardant agent to prevent jamming of the continuous paper 2 due to the adhesion of the adhesive agent to the contact surface 26*a*.

As described above, in the label printer 1 according to this embodiment, the contact surface 26*a* of the movable blade 26 is coated with the adhesion-retardant agent. Thus, when the continuous paper 2 conveyed on the conveying path 8 contacts the contact surface 26*a*, the continuous paper 2 may be easily taken off from the contact surface 26*a*, thereby preventing the jamming of the continuous paper 2 due to the adhesion of the continuous paper 2 to the contact surface 26*a*.

In a second embodiment, the opposite surface of the movable blade is inclined to be gradually further away from the fixed blade in a direction away from a lower side of the cutting surface. In the following description, description of the same portions as the first embodiment will be omitted and only portions different from the first embodiment will be described.

Figure 5:
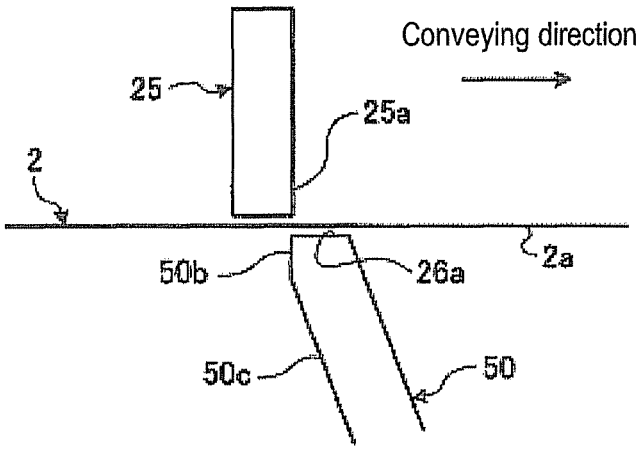
FIG. 5 is a side view showing a configuration of the fixed blade and the movable blade.

FIG. 5 is a side view showing a configuration of a fixed blade and a movable blade according to the second embodiment. In this embodiment, similarly to the movable blade 26 in the first embodiment, a movable blade 50 includes a contact surface 26*a*, a cutting surface 50*b* and an opposite surface 50*c*, all surfaces of which are coated with an adhesion-retardant agent except the cutting surface 50*b*.

In addition, in this embodiment, the opposite surface 50*c* of the movable blade 50 is inclined to be gradually further apart from the fixed blade 25 in a direction away from the cutting surface 50*b*. This configuration decreases the contact area between the movable blade 50 and the cutting surface 25*a* of the fixed blade 25 when the movable blade 50 moves upward to the conveying path 8 and slides on the cutting surface 25*a* of the fixed blade 25. Accordingly, this may prevent cutting failure of the continuous paper 2 due to the adhesion of the adhesive agent attached to the cutting surface 50*b* of the movable blade 50 to the cutting surface 25*a* of the fixed blade 25 when the continuous paper 2 is cut.

As described above, in the label printer 1 according to the second embodiment, by inclining the opposite surface 50*c* of the movable blade 50 to be gradually further apart from the fixed blade 25 in a direction away from the cutting surface 50*b*, the contact area between the fixed blade 25 and the movable blade 50 may be decreased when the continuous paper 2 inserted between the fixed blade 25 and the movable blade 50 is cut. This may prevent the cutting failure of the continuous paper 2 due to the adhesion of the adhesive agent attached to the movable blade 50 to the fixed blade 25 when the continuous paper 2 is cut.

In an alternative embodiment, the configuration of the fixed blade and the movable blade as described in the above embodiments may be applied to a rotary cutter. In the following description, description of the same portions as the above-described embodiments will be omitted and only portions different from the above-described embodiments will be described.

Figure 6:
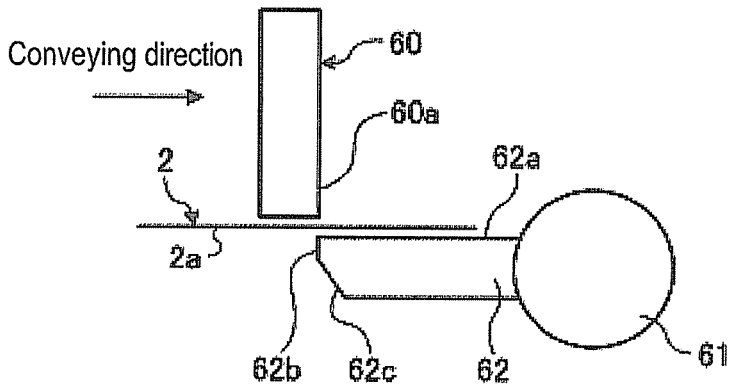
FIG. 6 is a side view showing a configuration of the fixed blade and the movable blade.

FIG. 6 is a side view showing a configuration of a fixed blade and a movable blade according to an alternative embodiment. In this embodiment, a fixed blade 60 includes an edge 60*a* having a length greater than the width of the continuous paper 2.

In this embodiment, a movable blade 62 cuts the continuous paper 2 as a contact point between the movable blade 62 and the edge 60*a* of the fixed blade 60 moves in a traverse direction of the continuous paper 2 (e.g., in a longitudinal direction extending from one end of movable blade 62 to the other end thereof) by rotation of the movable blade 62 around a rotation center (or rotary shaft) 61 disposed at a predetermined position. In one embodiment, the movable blade 62 provided on the outer periphery of the rotary shaft 61 is configured to extend from one end to the other end of the rotary shaft 61 at a predefined angle with respect to an axial direction of the rotary shaft 61. In addition, similar to the above-described embodiments, the movable blade 62 has a cutting surface 62*b* configured to cut the continuous paper 2 inserted between the cutting surface 62*b* and the edge 60*a* of the fixed blade 60. The movable blade 62 further includes a contact surface 62*a* configured to contact the adhesive-applied surface 2*a* of the continuous paper 2 conveyed on the conveying path 8, and an opposite surface 62*c* which is disposed below the cutting surface 62*b* in continuation with the cutting surface 62*b* and opposes the fixed blade 60.

Similar to the first embodiment, the movable blade 62 is entirely coated with an adhesion-retardant agent except the cutting surface 62*b*. Accordingly, even when the adhesive-applied surface 2*a* of the continuous paper 2 conveyed on the conveying path 8 contacts the contact surface 62*a*, the continuous paper 2 may be taken off easily from the contact surface 62*a*, which may prevent a jamming of the continuous paper 2 due to the adhesion of the continuous paper 2 to the contact surface 62*a*. In addition, even if an adhesive agent is attached to the cutting surface 62*b* when the continuous paper 2 is cut, the adhesive agent attached to the cutting surface 62*b* may flow down to the opposite surface 62*c*, which may prevent cutting failure of the continuous paper 2 due to the adhesive agent attached to the cutting surface 62*b*. Moreover, when the movable blade 62 contacts the edge 60*a* of the fixed blade 60, it is possible to prevent the adhesive agent attached to the cutting surface 62*b* of the movable blade 62 from being attached to the edge 60*a* of the fixed blade 60, which may prevent the cutting failure of the continuous paper 2 due to the adhesion of the adhesive agent.

In addition, similar to the second embodiment, the opposite surface 60*c* is inclined to be gradually further away from the fixed blade 60 in a direction away from the cutting surface 62*b*. Accordingly, when the movable blade 62 contacts the edge 60*a* of the fixed blade 60 as the movable blade 62 is rotated around the rotation center 61, it is possible to decrease the contact area between the movable blade 62 and the edge 60*a* of the fixed blade 60, which may prevent the cutting failure of the continuous paper 2 due to the adhesion of the adhesive agent attached to the cutting surface 62*b* of the movable blade 62 to the edge 60*a* of the fixed blade 60 when the continuous paper 2 is cut.

Thus, the rotary cutter according to this embodiment may obtain the same working effects as the first and second embodiments.

As described above, according to this embodiment and the first and second embodiments, it is possible to prevent a jamming of the continuous paper due to the adhesive surface of the continuous paper getting attached to the movable blade.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A cutter unit applicable to a printer including a conveying mechanism to convey a print paper in a conveying direction during printing having a print surface and an adhesive surface comprising:

a first blade provided on a conveying path of the print paper conveyed by the conveying mechanism to face the print surface of the print paper; and a second blade provided on the conveying path to face the adhesive surface, the second blade including a cutting surface configured to slide on a cutting surface of the first blade to cut the print paper inserted between the second and first blades, a contact surface configured to be coated with an adhesion-retardant agent and contact the adhesive surface of the print paper on the conveying path, and an inclined surface extending longitudinally down from the cutting surface of the second blade and inclined to be gradually further away from the first blade in the conveying direction of the print paper throughout an entire cutting process, wherein the inclined surface of the second blade is coated with an adhesion-retardant agent.

2. The cutter unit of claim 1, wherein the second blade is entirely coated with an adhesion-retardant agent except for the cutting surface.

3. The cutter unit of claim 1, wherein the contact surface includes a recess portion.

4. A printer comprising:

a conveying mechanism configured to convey a print paper in a conveying direction during printing having a print surface and an adhesive surface;

a printing mechanism provided on a conveying path to print an image on the print surface;

a first blade provided on the conveying path of the print paper conveyed by the conveying mechanism to face the print surface of the print paper; and a second blade provided on the conveying path to face the adhesive surface, the second blade including a cutting surface configured to slide on a cutting surface of the first blade to cut the print paper inserted between the second and first blades, a contact surface configured to be coated with an adhesion-retardant agent and contact the adhesive surface of the print paper on the conveying path, and an inclined surface extending longitudinally down from the cutting surface of the second blade and inclined to be gradually further away from the first blade in the conveying direction of the print paper throughout an entire cutting process, wherein the inclined surface of the second blade is coated with an adhesion-retardant agent.

5. The printer of claim 4, wherein the second blade is entirely coated with an adhesion-retardant agent except for the cutting surface.

6. The printer of claim 4, wherein the contact surface includes a recess portion.

7. A printer comprising:

a conveyer configured to convey a print paper in a conveying direction during printing having a print surface and an adhesive surface;

a printing mechanism configured to print an image on the print surface;

a first blade provided to face the print surface of the print paper; and a second blade provided to face the adhesive surface of the print paper, the second blade including a cutting surface configured to slide on a cutting surface of the first blade to cut the print paper inserted between the second and first blades, a contact surface configured to be coated with an adhesion-retardant agent and contact the adhesive surface of the print paper, and an inclined surface extending longitudinally down from the cutting surface of the second blade and inclined to be gradually further away from the first blade in the conveying direction of the print paper throughout an entire cutting process, wherein the inclined surface of the second blade is coated with an adhesion-retardant agent.

8. The printer of claim 7, wherein the second blade is entirely coated with an adhesion-retardant agent except for the cutting surface.

* * * * *